US010874183B1

(12) United States Patent
Wang et al.

(10) Patent No.: US 10,874,183 B1
(45) Date of Patent: Dec. 29, 2020

(54) PARASOL WITH HANDLE-SHELL-FREE STRUCTURE

(71) Applicant: Linhai Meiyang Parasol Industry Co.,Ltd, Zhejiang (CN)

(72) Inventors: Yingying Wang, Zhejiang (CN); Yuefu Ke, Zhejiang (CN); Xuliang Wang, Zhejiang (CN)

(73) Assignee: Linhai Meiyang Parasol Industry Co., Ltd, Zhejiang (CN)

( * ) Notice: Subject to any disclaimer, the term of this patent is extended or adjusted under 35 U.S.C. 154(b) by 0 days.

(21) Appl. No.: 16/817,659

(22) Filed: Mar. 13, 2020

(30) Foreign Application Priority Data

Dec. 30, 2019 (CN) ..... 2019 1 1398500

(51) Int. Cl.
*A45B 25/14* (2006.01)
*A45B 9/02* (2006.01)
*A45B 23/00* (2006.01)

(52) U.S. Cl.
CPC ..... *A45B 25/14* (2013.01); *A45B 9/02* (2013.01); *A45B 2023/0012* (2013.01); *A45B 2023/0037* (2013.01); *A45B 2025/146* (2013.01)

(58) Field of Classification Search
CPC ..... A45B 25/14; A45B 2023/0081; A45B 2023/0031
See application file for complete search history.

(56) References Cited

U.S. PATENT DOCUMENTS 5,116,258 A * 5/1992 Vennik ..... A45B 23/00 135/20.3
5,785,069 A * 7/1998 Glatz ..... A45B 23/00 135/20.1
6,923,193 B2 * 8/2005 Chen ..... A45B 23/00 135/20.1
9,930,942 B2 * 4/2018 Ma ..... A45B 17/00
2020/0297086 A1 * 9/2020 He ..... A45B 23/00

FOREIGN PATENT DOCUMENTS

EP 3219222 A1 * 9/2017 ..... A45B 23/00
WO WO-9523532 A1 * 9/1995 ..... A45B 23/00

* cited by examiner

*Primary Examiner* — Noah Chandler Hawk
(74) *Attorney, Agent, or Firm* — JCIPRNET

(57) ABSTRACT

A parasol includes a stand column and an umbrella cover assembly which includes a tilt strut. A sliding block is installed in cooperation with one end of the tilt strut. A chute is disposed on the stand column, and the sliding block is for sliding up and down along the chute. The chute is provided with a shading device. A collecting mechanism is coordinately arranged in the stand column, and includes a drive assembly, a clutch fork assembly and a transmission assembly. The transmission assembly includes a collecting and supporting transmission assembly and an inclination transmission assembly. The drive assembly is able to be in clutch cooperation with the collecting and supporting transmission assembly or the inclination transmission assembly under action of the clutch fork assembly.

10 Claims, 7 Drawing Sheets

PARASOL WITH HANDLE-SHELL-FREE STRUCTURE

CROSS-REFERENCE TO RELATED APPLICATION

This application claims the priority benefit of China application serial no. 201911398500.4, filed on Dec. 30, 2019. The entirety of the above-mentioned patent application is hereby incorporated by reference herein and made a part of this specification.

BACKGROUND

Technical Field

The present invention relates to the technical field of parasol, in particular to a parasol with a handle-shell-free structure.

Description of Related Art

Roman Umbrella is a common outdoor article in our daily life. For convenience, a handle shell for moving vertically is generally disposed on an umbrella stand column of the existing Roman Umbrella, and the handle shell is provided with a handle. Although it is convenient to open and close the Roman umbrella by the handle shell structure, the structure is complex, and the handle shell is left exposed, which not only affects appearance but is prone to equipment failure. In addition, the existing stand column of the Roman umbrella is provided with a chute which is generally exposed out. Thus, due to the fact that the Roman umbrella is an outdoor product, pollutants such as dust are bound to enter the chute after long-time use, which is inconvenient to clean and affects using life of the product.

SUMMARY

In view of the problems existing in the prior art, an objective of a design of the present invention is to provide a parasol with a handle-shell-free structure.

The present invention is implemented based on the following technical solutions.

The parasol with a handle-shell-free structure includes a stand column and an umbrella cover assembly. The umbrella cover assembly includes umbrella ribs, an umbrella plate and a tilt strut. A sliding block is installed in cooperation with one end of the tilt strut. A chute is disposed on the stand column, and the sliding block is used for sliding up and down along the chute. The chute is provided with a shading device for covering an inner cavity of the chute. A collecting mechanism is coordinately arranged in the stand column. The collecting mechanism includes a drive assembly, a clutch fork assembly and a transmission assembly. The transmission assembly includes a collecting and supporting transmission assembly and an inclination transmission assembly. The drive assembly is in clutch cooperation with the collecting and supporting transmission assembly or the inclination transmission assembly under action of the clutch fork assembly. Arrangement of shading device is able to keep an internal space of the stand column closed, thereby increasing using life of the product.

The drive assembly includes a crank handle, a crank handle shaft, a first gear and a second gear. The crank handle is fixedly connected with one end, extended out of the stand column, of the crank handle shaft. First bumps are disposed on an outer wall of the crank handle shaft along a circumferential direction, and a first concave groove is formed between adjacent two of the first bumps. The first gear and the second gear are sleeved at two ends of the crank handle shaft and are in clearance fit with the crank handle shaft. Second bumps and a second concave groove are disposed on opposite sides of the first gear and the second gear, and the second bumps are disposed corresponding to position of the first bumps, and the second concave groove is disposed corresponding to position of the first concave groove.

The clutch fork assembly includes a gear knob, a connecting column fixedly connected with an inner side of the gear knob, a shifting fork sleeved on the connecting column, a shifting plate clamped with the shifting fork, a moving clamping ring in matched connection with the shifting plate, and the moving clamping ring is sleeved on the crank handle shaft, and is located between the second gear and the first gear.

A first arc-shaped clamping groove is disposed on an upper end of the shifting fork, and the shifting plate includes a connecting plate which is formed as one piece, a second arc-shaped clamping groove and a slide column. The slide column and the second arc-shaped clamping groove are respectively arranged on two ends of the connecting plate. The slide column is sleeved on a fixing column, and two ends of the fixing column are respectively and fixedly connected with an inner wall of the stand column. The moving clamping ring includes an annular body, and third bumps are respectively disposed on two ends of the annular body. A third concave groove is formed between adjacent two of the third bumps, and inner bumps matched with the first groove are arranged at position, corresponding to the third bumps, of an inner wall of the annular body. An annular clamping groove is formed in a middle portion of an outer wall of the annular body, and the second arc-shaped clamping groove is clamped on the annular clamping groove.

The collecting and supporting transmission assembly includes a winding wheel meshed with the first gear, and the inclination transmission assembly includes a primary gear, a secondary gear, a tension transition gear, an upper sprocket, a lower sprocket and a chain. The secondary gear includes a large fluted disc and a small fluted disc, and the primary gear is meshed with the second gear and the large fluted disc respectively. The small fluted disc is connected with the tension transition gear through the chain. An upper end of the chain is fixedly connected with an upper end of the sliding block after winding the upper sprocket, and a lower end of the chain is connected with a lower end of the sliding block after winding the lower sprocket.

Decorative panels are respectively mounted on two ends of gear shafts of the primary gear, the secondary gear and the tension transition gear, and the decorative panels are fixedly connected with the inner wall of the stand column. Torsion springs are arranged on gear seats of the secondary gear and the tension transition gear, so that the secondary gear and the tension transition gear are always in a tensioning state. Under action of the torsion springs, the gears meshed with the chain are always in a stressed state that teeth abutted against each other, therefor, when the gears are meshed, due to clearance between each parts, an upper sliding block base is prevented from moving with clearance in the absence of a driving force, thereby influencing stability of product during use.

The shading device includes a baffle groove assembly symmetrically disposed on an opening side wall of the chute, an upper baffle assembly and a lower baffle assembly disposed in the baffle plate groove assembly. The upper baffle assembly and the lower baffle assembly for completely covering the chute are respectively disposed on two sides of the sliding block, thereby preventing sundries from entering into the stand column.

The baffle groove assembly includes an inner baffle groove, a middle baffle groove and an outer baffle groove. The upper baffle assembly includes an upper inner baffle plate, an upper middle baffle plate and an upper outer baffle plate, and the lower baffle assembly includes a lower inner baffle plate, a lower middle baffle plate and a lower outer baffle plate. The inner baffle groove is internally provided with the upper inner baffle plate and the lower inner baffle plate, and the middle baffle groove is internally provided with the upper middle baffle plate and the lower middle baffle plate, and the outer baffle groove is internally provided with the upper outer baffle plate and the lower outer baffle plate. The sliding block is slidably disposed in the chute, and a tilt-strut connection piece is fixedly disposed on position, corresponding to an opening of the chute, of the sliding block.

The upper inner baffle plate is fixedly disposed at an upper end of the inner baffle groove, and the lower inner baffle plate is fixedly disposed at a lower end of the inner baffle groove. The sliding block is fixedly connected with a lower end of the upper outer baffle plate and an upper end of the lower outer baffle plate respectively.

The parasol with the handle-shell-free structure. The upper middle baffle plate and the lower middle baffle plate are slidably disposed in the middle baffle groove respectively, and clamp blocks for abutting against each other are respectively disposed between a lower end of the upper middle baffle plate and an upper end of the upper outer baffle plate, and between an upper end of the lower middle baffle plate and a lower end of the lower outer baffle plate, and the stand column is further provided with a sliding block clamp.

In this invention, the collecting mechanism is able to replace a handle-shell structure used in the traditional Roman Umbrella, so that the structure is simpler, the assembly is more convenient and rapid and aesthetic extent of the product is improved at the same time. Also, the arrangement of the shading device ensures that the chute on the stand column is always in a closed state so as to prevent sundries and dirt from entering the chute, thereby improving the overall cleanliness of the product and increasing the using life of the product.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

The present invention is further described in detail below with reference to the accompanying drawings of the specification, and specific implementations are provided.

A parasol with a handle-shell-free structure of the invention has a collecting mechanism arranged inside, which replaces a handle-shell structure for opening and closing used in the traditional Roman Umbrella, thus the product structure is simplified and the aesthetics is improved. Meanwhile, it is also convenient for users to assemble. Also, arrangement of the shading device improves using life of the product under the condition of wind, sun and rain.

Figure 1:
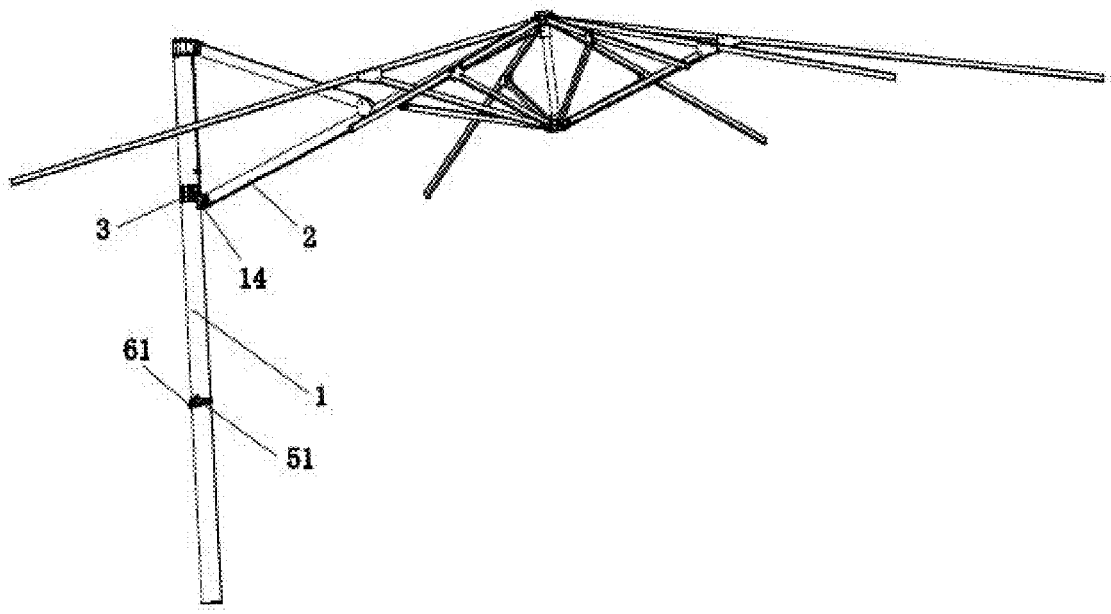
FIG. 1 is a schematic diagram of an overall structure of the present invention.
Figure 2:
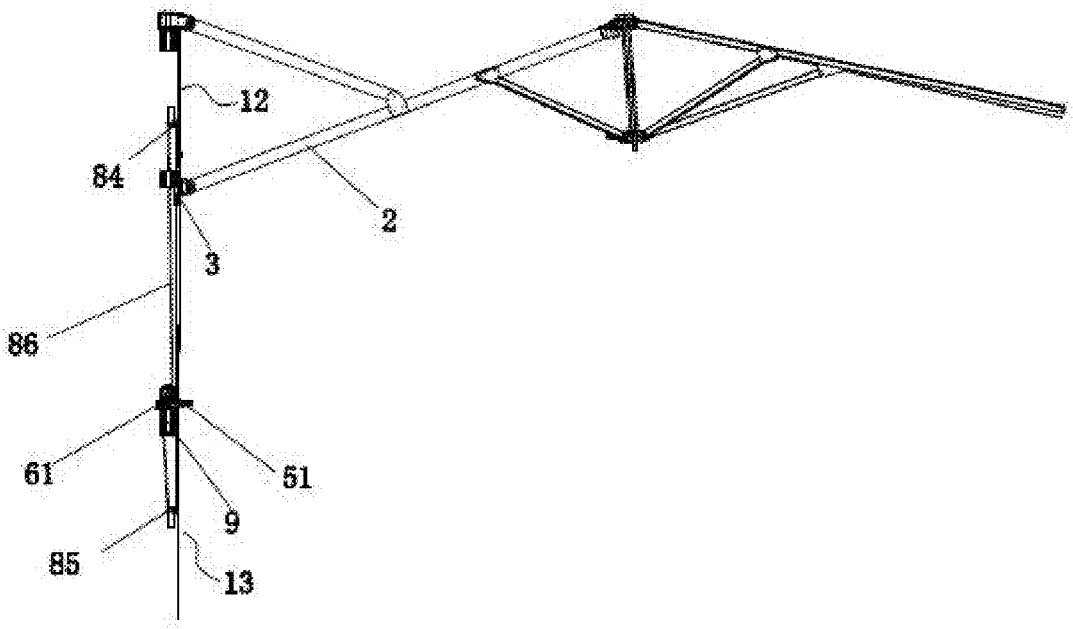
FIG. 2 is a structural diagram of FIG. 1 without a stand column.
Figure 3:
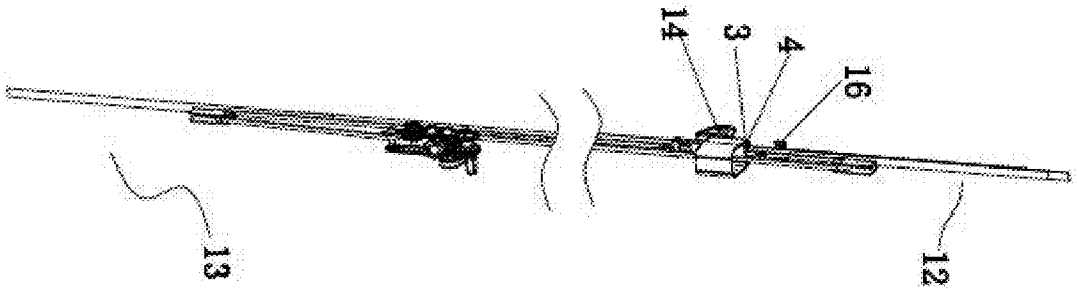
FIG. 3 is an assembly structure diagram of a collecting mechanism and a shading device.

As shown in FIG. 1 to FIG. 3, specific structure of the invention includes a stand column 1 and an umbrella cover assembly. A crank handle 51 is disposed on the stand column 1. The umbrella cover assembly includes umbrella ribs, an umbrella plate and a tilt strut 2. A sliding block 3 is installed in cooperation with one end of the tilt strut. A chute 4 is disposed on the stand column 1, and the sliding block 3 is used for sliding up and down along the chute 4. The chute 4 is provided with a shading device for covering an inner cavity of the chute 4. A collecting mechanism is coordinately arranged in the stand column 1. The collecting mechanism includes a drive assembly 5, a clutch fork assembly 6 and a transmission assembly. The transmission assembly includes a collecting and supporting transmission assembly 7 and an inclination transmission assembly 8. The drive assembly 5 is able to be in clutch cooperation with the collecting and supporting transmission assembly 7 or the inclination transmission assembly 8 under action of the clutch fork assembly 6.

Figure 4:
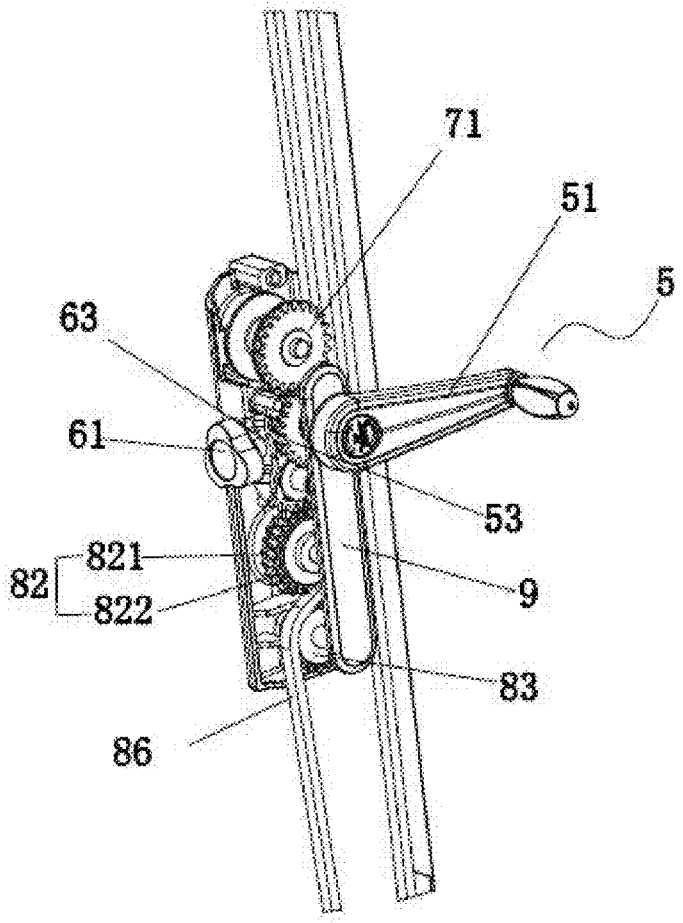
FIG. 4 is a structural diagram of a collecting mechanism.
Figure 5:
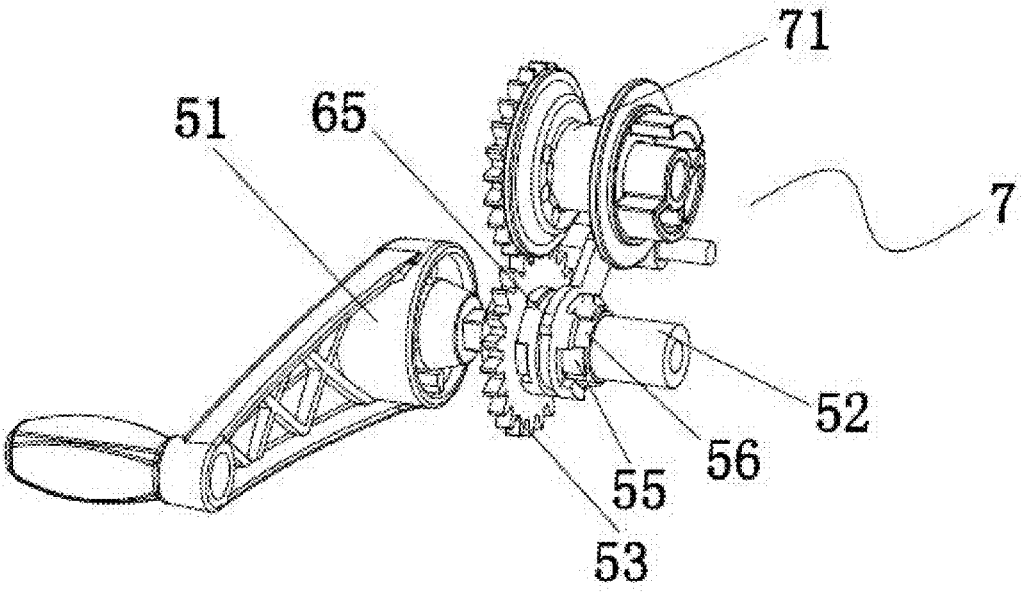
FIG. 5 is a structural diagram of a collecting and supporting transmission assembly.
Figure 6:
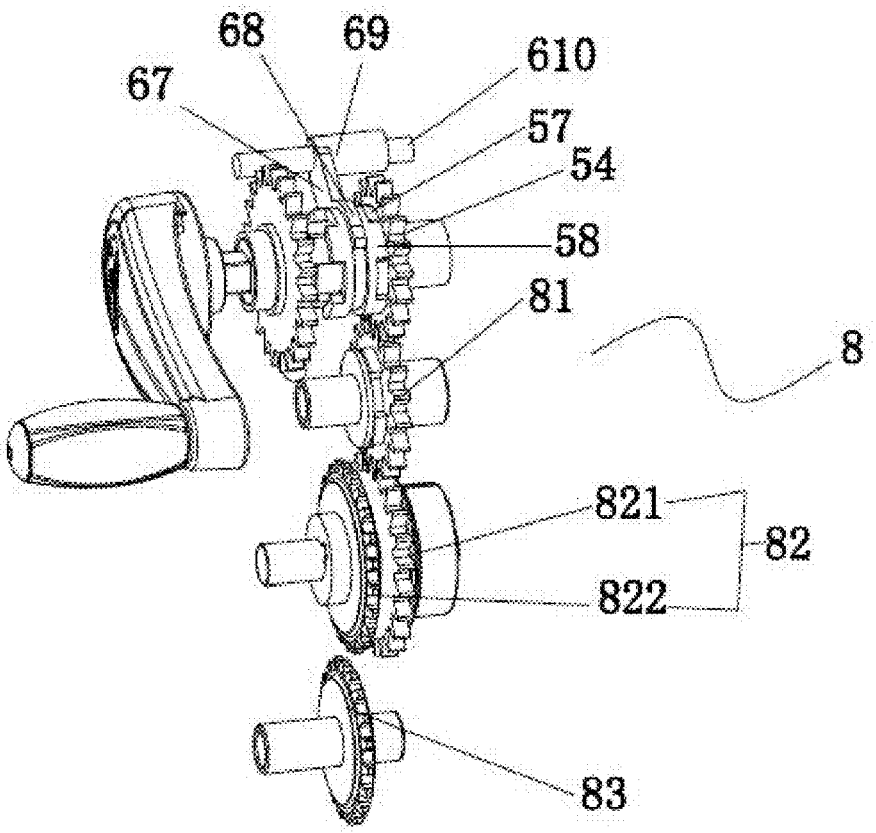
FIG. 6 is a structural diagram of an inclination transmission assembly.

As shown in FIG. 4 to FIG. 6, the drive assembly 5 includes the crank handle 51, a crank handle shaft 52, a first gear 53 and a second gear 54. The crank handle 51 is fixedly connected with one end, extended out of the stand column 1, of the crank handle shaft 52. First bumps 55 are disposed on an outer wall of the crank handle shaft 52 along a circumferential direction, and a first concave groove 56 is formed between adjacent two of the first bumps 55. The first gear 53 and the second gear 54 are sleeved at two ends of the crank handle shaft 52 and are in clearance fit with the crank handle shaft 52. Second bumps 57 and a second concave groove 58 are disposed on a side of the first gear 53 and a side of the second gear 54 that is opposite to the side of the first gear 53, and the second bumps 57 are disposed corresponding to position of the first bumps 55, and the second concave groove 58 is disposed corresponding to position of the first concave groove 56.

Figure 7:
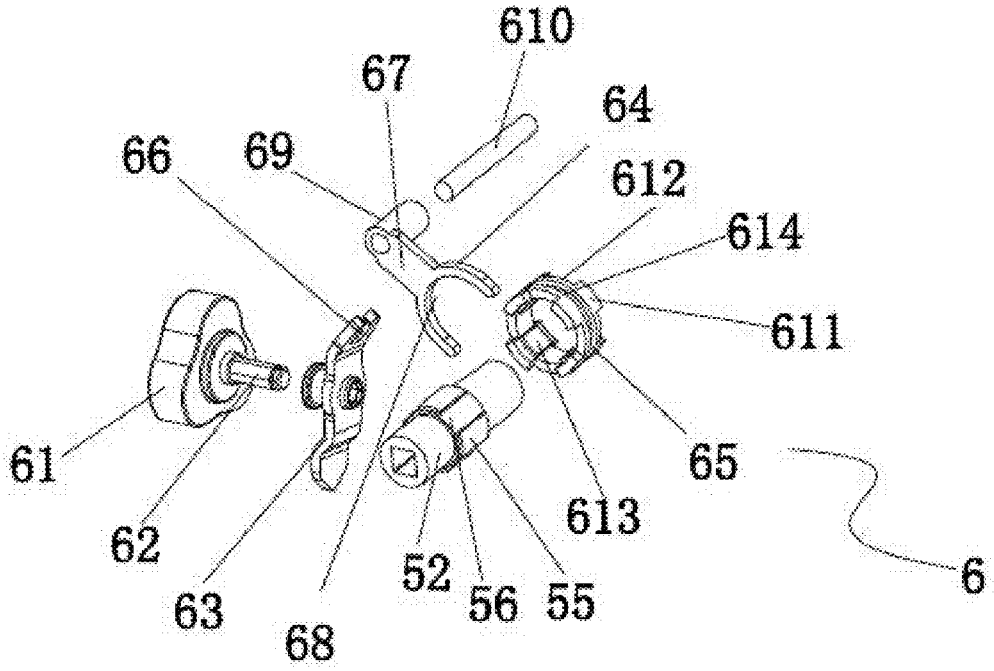
FIG. 7 is an exploded view of a clutch fork assembly.

As shown in FIG. 7, the clutch fork assembly 6 includes a gear knob 61, a connecting column 62 fixedly connected with an inner side of the gear knob 61, a shifting fork 63 sleeved on the connecting column 62, a shifting plate 64 clamped with the shifting fork 63, a moving clamping ring 65 in matched connection with the shifting plate 64. The moving clamping ring 65 is sleeved on the crank handle shaft 52, and is located between the second gear 54 and the first gear 53. A first arc-shaped clamping groove 66 is disposed on an upper end of the shifting fork 63. The shifting plate 64 includes a connecting plate 67 which is formed as one piece, a second arc-shaped clamping groove 68 and a slide column 69. The slide column 69 and the second arc-shaped clamping groove 68 are respectively arranged on two ends of the connecting plate 67. The slide column 69 is sleeved on a fixing column 610, and two ends of the fixing column 610 are respectively and fixedly connected with an inner wall of the stand column 69. The moving clamping ring 65 includes an annular body, and third bumps 611 are respectively disposed on two ends of the annular body. A third concave groove 612 is formed between adjacent two of the third bumps 611, and inner bumps 613 matched with the first groove 56 are arranged at position, corresponding to the third bumps 611, of an inner wall of the annular body. An annular clamping groove 614 is formed in a middle portion of an outer wall of the annular body, and the second arc-shaped clamping groove 68 is clamped on the annular clamping groove 614.

As shown in FIG. 5 and FIG. 6, the collecting and supporting transmission assembly 7 includes a winding wheel 71 meshed with the first gear 53. The winding wheel 71 is used for storing an umbrella rope, and the specific structure of the umbrella rope on the winding wheel 71 and the connection relationship with the parasol are the same as those in the prior art, and are not described in detail.

The inclination transmission assembly 8 is mainly used for driving the sliding block 3 to move up and down. The inclination transmission assembly 8 includes a primary gear 81, a secondary gear 82, a tension transition gear 83, an upper sprocket 84, a lower sprocket 85 and a chain 86. The secondary gear 82 includes a large fluted disc 821 and a small fluted disc 822, and the primary gear 81 is meshed with the second gear 84 and the large fluted disc 821 respectively. The small fluted disc 822 is connected with the tension transition gear 83 through the chain 86. An upper end of the chain 86 is fixedly connected with an upper end of the sliding block 3 after winding the upper sprocket 84, and a lower end of the chain 86 is connected with a lower end of the sliding block 3 after winding the lower sprocket 85.

Figure 11:
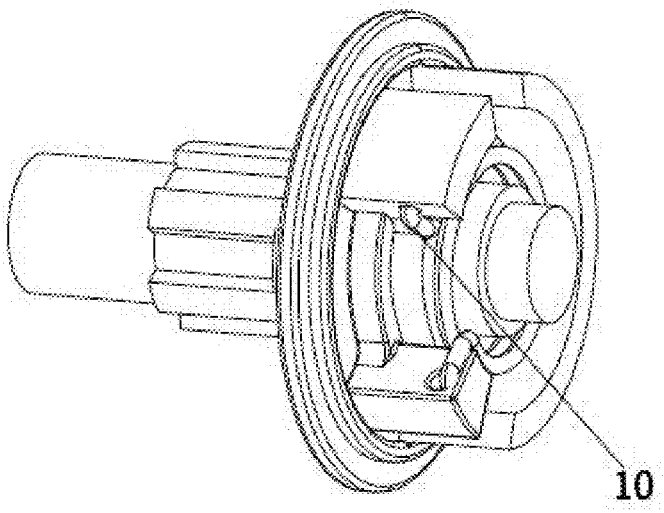
FIG. 11 is an installation structural diagram of torsion springs.

Preferably, decorative panels 9 are respectively mounted on two ends of gear shafts of the primary gear 81, two ends of the secondary gear 82 and two ends of the tension transition gear 83. The decorative panels 9 are fixedly connected with the inner wall of the stand column 1. Torsion springs 10 are arranged on gear seat of the secondary gear 82 and gear seat of the tension transition gear 83, so that the secondary gear 82 and the tension transition gear 83 are always in a tensioning state. Under action of the torsion springs 10, the gears meshed with the chain 86 are always in a stressed state that teeth abutted against each other, therefore, when the gears are meshed, due to clearance between each parts, an upper sliding block base is prevented from moving with clearance in the absence of a driving force, thereby influencing stability of product during use. The installation position of the torsion springs 10 is shown in FIG. 11.

Figure 8:
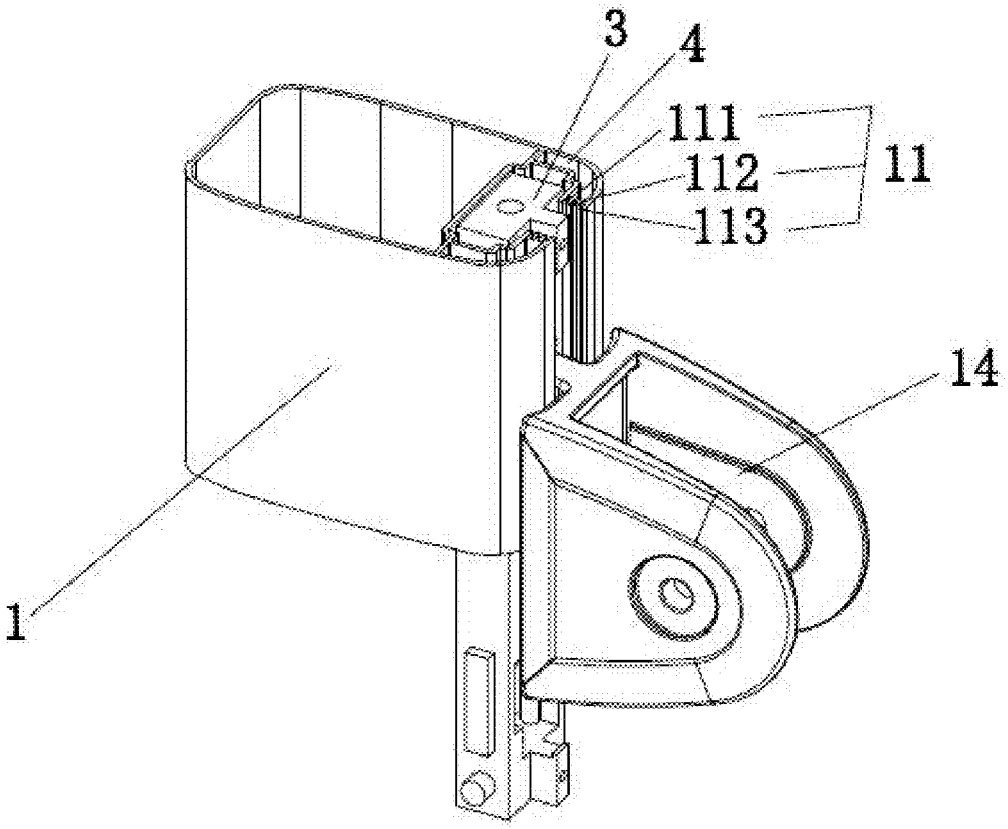
FIG. 8 is an installation structural diagram of a sliding block and a chute.
Figure 9:
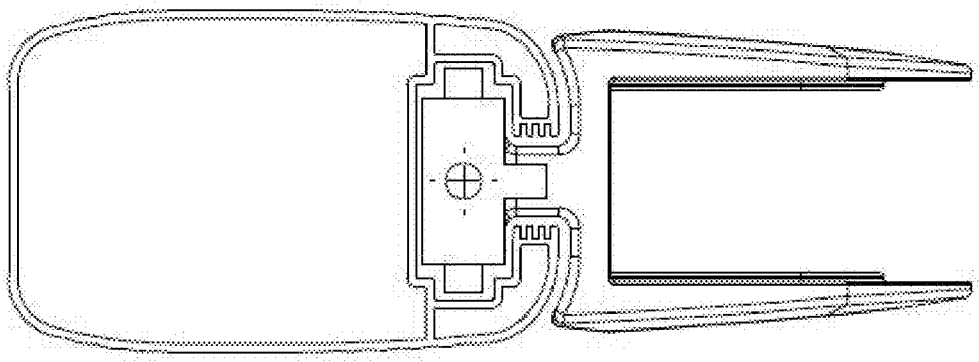
FIG. 9 is a schematic diagram of a top view structure of FIG. 8.
Figure 10:
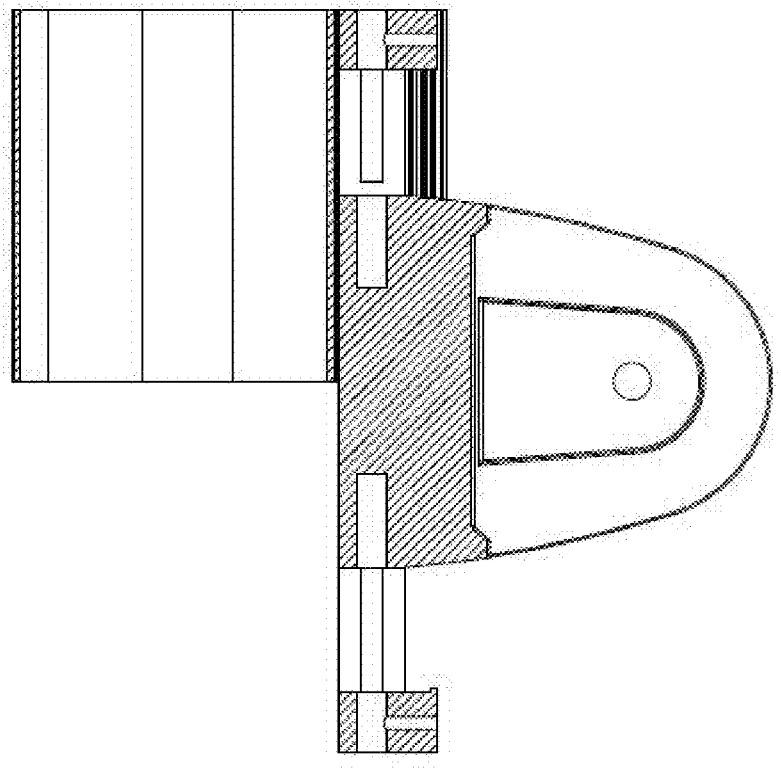
FIG. 10 is a section view of FIG. 8.
Figure 12:
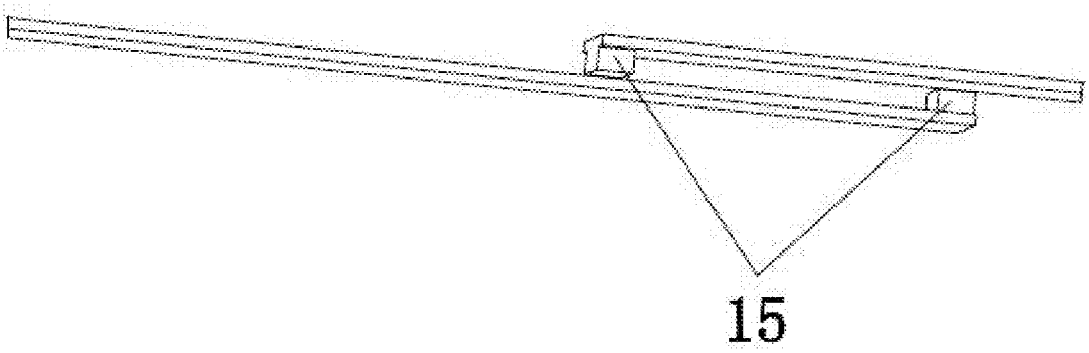
FIG. 12 is a structural diagram of clamp blocks for abutting against each other.

As shown in FIG. 8, to FIG. 10 and FIG. 12, the shading device includes a baffle groove assembly 11 symmetrically disposed on an opening side wall of the chute 4, an upper baffle assembly 12 and a lower baffle assembly 13 disposed in the baffle plate groove assembly 11. The upper baffle assembly 12 and the lower baffle assembly 13 for completely covering the chute 4 are respectively disposed on two sides of the sliding block 3. The baffle groove assembly 11 includes an inner baffle groove 111, a middle baffle groove 112 and an outer baffle groove 113. The upper baffle assembly 12 includes an upper inner baffle plate, an upper middle baffle plate and an upper outer baffle plate. The lower baffle assembly includes a lower inner baffle plate, a lower middle baffle plate and a lower outer baffle plate. The inner baffle groove is internally provided with the upper inner baffle plate and the lower inner baffle plate, and the middle baffle groove is internally provided with the upper middle baffle plate and the lower middle baffle plate, and the outer baffle groove 113 is internally provided with the upper outer baffle plate and the lower outer baffle plate. The sliding block 3 is slidably disposed in the chute 4, and a tilt-strut connection piece 14 is fixedly disposed on a position, corresponding to an opening of the chute 4, of the sliding block 3.

Preferably, the upper inner baffle plate is fixedly disposed at an upper end of the inner baffle groove 111, and the lower inner baffle plate is fixedly disposed at a lower end of the inner baffle groove 111. The sliding block 3 is fixedly connected with a lower end of the upper outer baffle plate and an upper end of the lower outer baffle plate respectively. The upper middle baffle plate and the lower middle baffle plate are slidably disposed in the middle baffle groove 112 respectively. Clamp blocks 15 for abutting against each other are respectively disposed between a lower end of the upper middle baffle plate and an upper end of the upper outer baffle plate, and between an upper end of the lower middle baffle plate and a lower end of the lower outer baffle plate. In the invention, the chute 4 is able to be completely covered through vertical moving of the sliding block 3, and the stand column 1 is further provided with a sliding block clamp 16.

During the process of closing the parasol, the gear knob 61 is turned in one direction, and the shifting fork 63 moves to drive the connecting plate 67 to clamp with the shifting fork 63, thereby driving the second arc-shaped clamping groove 68 to toggle the moving clamping ring 65 to move until the third bumps 611 mesh with the second concave groove 58 on one end of the moving clamping ring 65 and the third concave groove 612 meshes with the second bumps 57. Then, the third bumps 611 and the third concave groove 612 on another end of the moving clamping ring 65 are respectively meshed with the first concave groove 56 and the first bumps 55 on the crank handle shaft 52. At this time, turning the crank handle 51, and the crank handle shaft 52 is rotated, driving the first bumps 55 and the first concave groove 56 to rotate, so that the moving clamping ring 65 rotates, and then the first gear 53 is driven to rotate, so as to drive the winding wheel 71 to rotate, and the umbrella rope is driven to move, thereby closing the umbrella cover. Next, turning the gear knob 61 in an opposite direction, and the shifting fork 63 starts to move and drives the connecting plate 67 to clamp with the shifting fork 63, thereby driving the second arc-shaped clamping groove 68 to toggle the moving clamping ring 65 to move, and the inner bumps 613 on the moving clamping ring 65 move toward the second gear 54 along the first concave groove 56, and the moving mode is the same as the above until the second gear 54 meshes with the moving clamping ring 65. At this moment, the crank handle 51 is turned and the crank handle shaft 52 is rotated, and then the moving clamping ring 65 is rotated, driving the second gear 54 to rotate, and the second gear 54 drives the primary gear 81 to rotate, then the large fluted disc 821 meshed with the second gear 54 is driven to rotate and drives rotating shaft of the large fluted disc 821 to rotate, so as to drive the small fluted disc 822 to rotate. Then, the chain 86 is driven to move and drives the tension transition gear 83, the lower sprocket 85 and the upper sprocket 84, so the sliding block 3 is able to move up and down. During moving of the sliding block 3, the upper outer baffle plate and the lower outer baffle plate connected with the sliding block 3 are driven to move. During moving, when the clamp blocks 15 on the upper outer baffle plate or the lower outer baffle plate are abutted against the clamp blocks 15 on the upper middle baffle plate or the lower middle baffle plate, the upper middle baffle plate or the lower middle baffle plate are driven to move together, thereby completely covering the chutes 4.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A parasol with a handle-shell-free structure, the parasol comprising a stand column and an umbrella cover assembly, wherein the umbrella cover assembly comprises umbrella ribs, an umbrella plate and a tilt strut, a sliding block is installed in cooperation with one end of the tilt strut; a chute is disposed on the stand column, and the sliding block is used for sliding up and down along the chute, the chute is provided with a shading device for covering an inner cavity of the chute; a collecting mechanism is coordinately arranged in the stand column, the collecting mechanism comprises a drive assembly, a clutch fork assembly and a transmission assembly, and the transmission assembly comprises a collecting and supporting transmission assembly and an inclination transmission assembly, the drive assembly is able to be in clutch cooperation with the collecting and supporting transmission assembly or the inclination transmission assembly under action of the clutch fork assembly.

2. The parasol with the handle-shell-free structure according to claim 1, wherein the drive assembly comprises a crank handle, a crank handle shaft, a first gear and a second gear, the crank handle is fixedly connected with one end, extended out of the stand column, of the crank handle shaft, and first bumps are disposed on an outer wall of the crank handle shaft along a circumferential direction, and a first concave groove is formed between adjacent two of the first bumps; the first gear and the second gear are sleeved at two ends of the crank handle shaft and are in clearance fit with the crank handle shaft, second bumps and a second concave groove are disposed on a side of the first gear and a side of the second gear that is opposite to the side of the first gear, and the second bumps are disposed corresponding to position of the first bumps, and the second concave groove is disposed corresponding to position of the first concave groove.

3. The parasol with the handle-shell-free structure according to claim 2, wherein the clutch fork assembly comprises a gear knob, a connecting column fixedly connected with an inner side of the gear knob, a shifting fork sleeved on the connecting column, a shifting plate clamped with the shifting fork, and a moving clamping ring in matched connection with the shifting plate, and the moving clamping ring is sleeved on the crank handle shaft, and is located between the second gear and the first gear.

4. The parasol with the handle-shell-free structure according to claim 3, wherein a first arc-shaped clamping groove is disposed on an upper end of the shifting fork, and the shifting plate comprises a connecting plate which is formed as one piece, a second arc-shaped clamping groove and a slide column, the slide column and the second arc-shaped clamping groove are respectively arranged on two ends of the connecting plate; the slide column is sleeved on a fixing column, and two ends of the fixing column are respectively and fixedly connected with an inner wall of the stand column; the moving clamping ring comprises an annular body, and third bumps are respectively disposed on two ends of the annular body, a third concave groove is formed between adjacent two of the third bumps, and inner bumps matched with the first groove are arranged at position, corresponding to the third bumps, of an inner wall of the annular body, an annular clamping groove is formed in a middle portion of an outer wall of the annular body, and the second arc-shaped clamping groove is clamped on the annular clamping groove.

5. The parasol with the handle-shell-free structure according to claim 2, wherein the collecting and supporting transmission assembly comprises a winding wheel meshed with the first gear, and the inclination transmission assembly comprises a primary gear, a secondary gear, a tension transition gear, an upper sprocket, a lower sprocket and a chain, the secondary gear comprises a large fluted disc and a small fluted disc, and the primary gear is meshed with the second gear and the large fluted disc respectively; the small fluted disc is connected with the tension transition gear through the chain, an upper end of the chain is fixedly connected with an upper end of the sliding block after winding the upper sprocket, and a lower end of the chain is connected with a lower end of the sliding block after winding the lower sprocket.

6. The parasol with the handle-shell-free structure according to claim 5, wherein decorative panels are respectively mounted on two ends of gear shafts of the primary gear, two ends of the secondary gear and two ends of the tension transition gear, and the decorative panels are fixedly connected with an inner wall of the stand column; torsion springs are arranged on a gear seat of the secondary gear and a gear seat of the tension transition gear, so that the secondary gear and the tension transition gear are always in a tensioning state.

7. The parasol with the handle-shell-free structure according to claim 1, wherein the shading device comprises a baffle groove assembly symmetrically disposed on an opening side wall of the chute, an upper baffle assembly and a lower baffle assembly disposed in the baffle plate groove assembly, the upper baffle assembly and the lower baffle assembly for completely covering the chute are respectively disposed on two sides of the sliding block.

8. The parasol with the handle-shell-free structure according to claim 7, wherein the baffle groove assembly comprises an inner baffle groove, a middle baffle groove and an outer baffle groove, the upper baffle assembly comprises an upper inner baffle plate, an upper middle baffle plate and an upper outer baffle plate, and the lower baffle assembly comprises a lower inner baffle plate, a lower middle baffle plate and a lower outer baffle plate; the inner baffle groove is internally provided with the upper inner baffle plate and the lower inner baffle plate, and the middle baffle groove is internally provided with the upper middle baffle plate and the lower middle baffle plate, and the outer baffle groove is internally provided with the upper outer baffle plate and the lower outer baffle plate, the sliding block is slidably disposed in the chute, and a tilt-strut connection piece is fixedly disposed on a position, corresponding to an opening of the chute, of the sliding block.

9. The parasol with the handle-shell-free structure according to claim 8, wherein the upper inner baffle plate is fixedly disposed at an upper end of the inner baffle groove, and the lower inner baffle plate is fixedly disposed at a lower end of the inner baffle groove, the sliding block is fixedly connected with a lower end of the upper outer baffle plate and an upper end of the lower outer baffle plate respectively.

10. The parasol with the handle-shell-free structure according to claim 8, wherein the upper middle baffle plate and the lower middle baffle plate are slidably disposed in the middle baffle groove respectively, and clamp blocks for abutting against each other are respectively disposed between a lower end of the upper middle baffle plate and an upper end of the upper outer baffle plate, and between an upper end of the lower middle baffle plate and a lower end of the lower outer baffle plate, and the stand column is further provided with a sliding block clamp.

* * * * *